US008173081B2

(12) United States Patent
Lee et al.

(10) Patent No.: US 8,173,081 B2
(45) Date of Patent: May 8, 2012

(54) STOPPER BODY

(75) Inventors: Stephen John Lee, Cardross Scotland (GB); Stuart Alexander William Mungall, Duntocher Clydebank Scotland (GB); Derek James Chalmers, Monkton Prestwick Scotland (GB)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 0 days.

(21) Appl. No.: 13/124,874

(22) PCT Filed: Oct. 31, 2009

(86) PCT No.: PCT/EP2009/007812

§ 371 (c)(1),
(2), (4) Date: Apr. 19, 2011

(87) PCT Pub. No.: WO2010/057570

PCT Pub. Date: May 27, 2010

(65) Prior Publication Data

US 2011/0200502 A1 Aug. 18, 2011

(30) Foreign Application Priority Data

Nov. 19, 2008 (EP) ..... 08020129

(51) Int. Cl.
*B01L 99/00* (2010.01)

(52) U.S. Cl. ..... 422/568; 422/537; 251/205; 251/206; 251/324; 251/325; 222/528; 222/566; 222/567; 222/569; 222/570; 222/591; 222/594; 222/595; 222/596; 222/597; 222/598; 222/599; 222/600; 222/601; 222/602; 222/603

(58) Field of Classification Search ..... 422/568; 222/528, 566, 567, 569, 570, 591–607; 251/205, 251/206, 324, 325
See application file for complete search history.

(56) References Cited

U.S. PATENT DOCUMENTS

| | | | | | |
|---|---|---|---|---|---|
| 3,084,038 | A | * | 4/1963 | Finkl | 75/509 |
| 4,610,436 | A | * | 9/1986 | LaBate et al. | 266/272 |
| 4,706,944 | A | * | 11/1987 | Lee | 266/272 |
| 4,877,705 | A | * | 10/1989 | Polidor | 428/34.6 |
| 5,190,674 | A | * | 3/1993 | Monks | 222/590 |
| 5,259,596 | A | * | 11/1993 | Ruffaldi | 266/271 |
| 5,328,064 | A | * | 7/1994 | Nanba et al. | 222/607 |
| 5,954,989 | A | * | 9/1999 | Brook et al. | 222/600 |
| 6,425,505 | B1 | * | 7/2002 | Heaslip et al. | 222/594 |
| 6,675,996 | B1 | * | 1/2004 | Miyamoto et al. | 222/594 |
| 6,913,730 | B2 | * | 7/2005 | Moriarty et al. | 266/272 |
| 2004/0145096 | A1 | * | 7/2004 | Moriarty et al. | 266/272 |
| 2006/0261100 | A1 | * | 11/2006 | Morales et al. | 222/597 |
| 2007/0210494 | A1 | * | 9/2007 | Guillo | 266/217 |

FOREIGN PATENT DOCUMENTS

EP 1401599 B1 10/2004

* cited by examiner

*Primary Examiner* — Jill Warden
*Assistant Examiner* — Shogo Sasaki
(74) *Attorney, Agent, or Firm* — Christopher L. Parmelee; Walker & Jocke

(57) ABSTRACT

A stopper body of refractory material and cylindrical shape having a first end (10), a second end (14) and an intermediate zone (12) there between, with a bore (16) of circular cross section, extending from said first end (10) in an axial direction of the stopper body into said intermediate zone (12) towards the second end (14), wherein the said bore being provided with an enlarged cross section (at 16*s*) along at least part of said intermediate Zone (12).

11 Claims, 2 Drawing Sheets

STOPPER BODY

This invention refers to a stopper body made of a refractory ceramic material. Such a stopper is used as a part of a valve mechanism to control the flow of molten metal guided through a nozzle arranged in a bottom of a metallurgical, the metal melt containing vessel. Such vessel can be a ladle, a tundish or the like.

The stopper body typically is made in one piece, which is then called a monobloc stopper. It is often manufactured in an isostatic press to achieve a sufficient high mechanical strength and service time.

The stopper body, hereinafter called as well the stopper, typically has a substantially cylindrical shape, comprising a first end, which is in the mounted position of the stopper the upper end. From this first end a bore extends in an axial direction of said stopper towards a second end, which corresponds in the mounted position of the stopper to the lower end. Said lower end is typically designated as a so called nose portion and characterized by a tapered or rounded profile. An intermediate zone is arranged between first and second end of the stopper.

Along the bore portion extending through the first end means are arranged for attachment of the stopper to the lifting mechanism, by which the stopper may be lifted vertically up and down from a seating (closing) position on the nozzle to a position in a distance to said nozzle in order to give the path for the metal melt stream partly or totally free.

In EP 1401599B1 a stopper rod of the type mentioned above is disclosed, characterized by an intermediate zone of a reduced outer diameter compared with the first and second stopper end in order to save refractory material.

It is an object of the invention to provide an alternative to said last mentioned stopper and especially to improve the mechanical strength of said stopper as is was recognized that the known stopper provides insufficient mechanical strength along the intermediate zone of reduced outer diameter.

DETAILED DESCRIPTION

Figure 1:
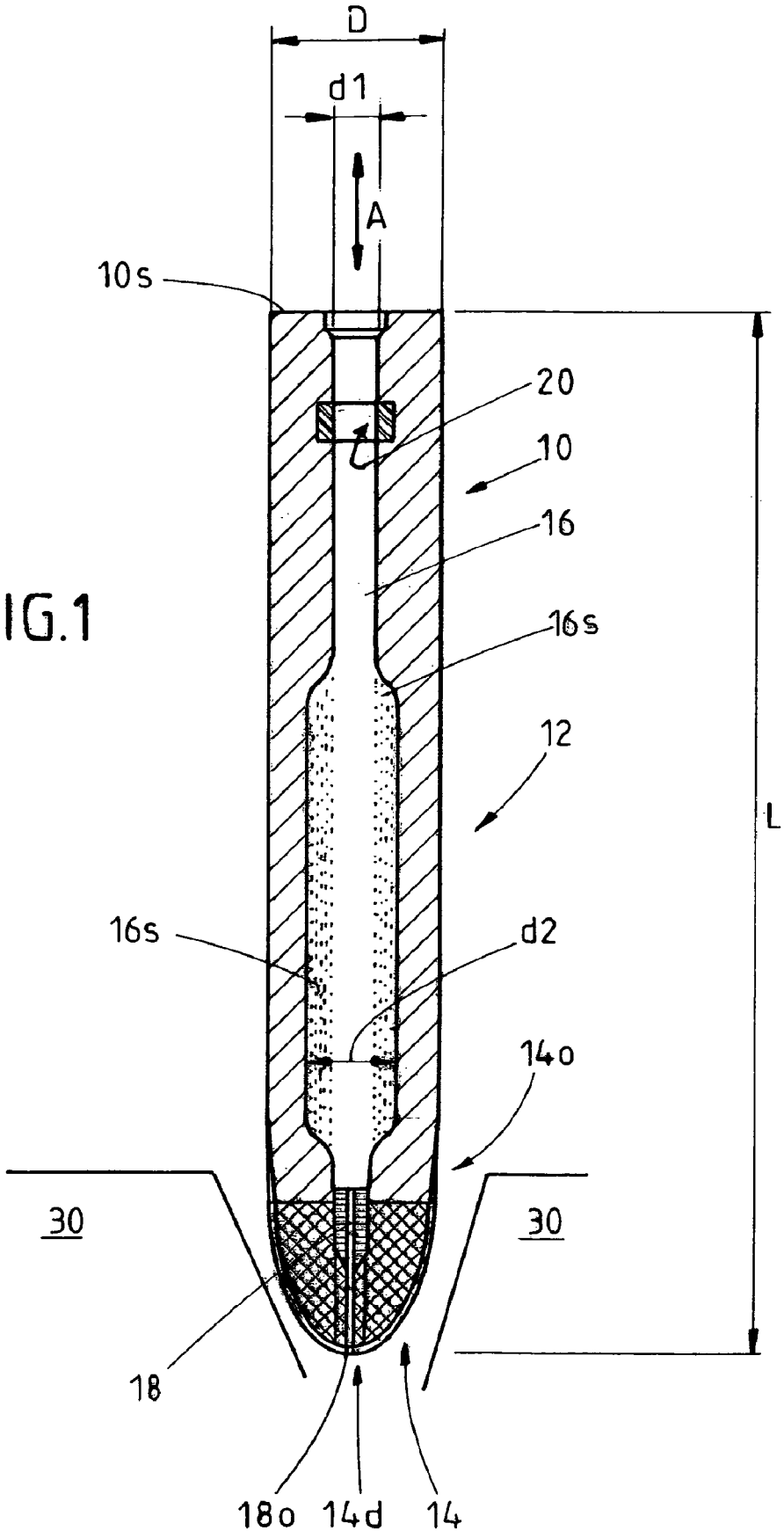
FIG. 1 shows a longitudinal sectional view of a stopper.

In various test series is was found that the mechanical strength of a stopper may be kept more or less unchanged compared with a standard stopper of cylindrical shape with constant wall thickness between first and second end, although less refractory material being used, when the bore section running through the intermediate zone being designed with an enlarged bore cross section compared with the bore section within the first end.

In other words: The outer diameter of the stopper according to invention remains substantially constant and cylindrical along said first end and said intermediate zone while the second end being designed conventionally, for example as a tapered nose portion.

"Substantially cylindrical" and "more or less constant" respectively means that the shape corresponds to stopper rods according to prior art with just manufacturing tolerances of the outer and inner stopper diameter in the range of 1-5%.

The inner bore is the decisive inventive feature as it comprises two bore portions of different cross section.

While the bore portion at the first end, including the fixing means for attachment to the lifting apparatus, remains again more or less unchanged with respect to prior art stoppers, the bore section following the first bore section in the direction of the second stopper end (the nose portion) is now provided with a larger cross section, i.e. the inner diameter of the stopper along at least part of the intermediate zone is increased compared with the section above (along the first end) and thus the wall thickness along said intermediate zone is smaller (thinner) than with conventional stoppers.

This saves refractory material, similar to the design according to EP 1401599B1 but with the advantage that the mechanical strength of the inventive stopper in the modified region (intermediate zone) and in total is characteristically higher than with the prior art device. The mechanical strength includes the strength transverse to the longitudinal axis of the stopper.

The mechanical strength is improved as the outer diameter (outer cross section) of the stopper is more or less constant along said intermediate zone and more or less identical to that of the first end. There is no tapered region between first end and intermediate zone weakening the stopper. The influence of the reduced wall thickness of the intermediate zone is of far less importance to the mechanical behavior of the stopper in total and just in the range of a few percent as will be shown hereinafter. The new stopper design resists higher stresses developed in said intermediate zone than a prior art stopper of the construction mentioned. Such stresses may derive i.a. from a lifting mechanism due to axial misalignment arising during service operations.

In its most general embodiment the invention relates to a stopper body of refractory material and substantially cylindrical shape having a first end, a second end and an intermediate zone between first and second end, with a bore of substantially circular cross section, extending from said first end in an axial direction of the stopper body into said intermediate zone towards the second end, wherein the said bore being provided with an enlarged cross section along at least part of said intermediate zone.

The enlarged cross section of the bore may be at least two times the cross section of the bore within the first portion. In case the cross section of the bore within the first end varies reference is made to the cross section of the bore within the first end where the attachment means are arranged.

According to a further embodiment of the invention the cross section of the enlarged bore portion may be more than three times, more than four times or even more than five times larger than the average cross section of the bore within the first end of the stopper.

As mentioned the bore along the intermediate zone is typically of circular cross section but may be slightly oval as well or may have another design. The same is true with respect to the bore portion extending through the first portion.

The enlarged bore portion may extend over 10 to 90% of the total length of the stopper body, wherein the total length being defined as the distance between the most opposing points of the stopper in its longitudinal (axial) direction.

As the first and second end typically each extend over about 10-25% of the total stopper length the enlarged bore portion will often be in the range of 30-80% of the total stopper length. It is obvious that the longer the enlarged bore portion is the less refractory material being necessary and the more the costs are reduced. The same is true, if the cross section of the enlarged bore portion is increased, i.e. if the wall thickness along this intermediate zone further reduced.

The enlarged bore channel typically ends in front of the second lower end of the stopper but may extend as well slightly into said second end (nose portion).

The transition region between the bore portions of different cross section should be designed smoothly in order to avoid sharp edges, which lower the mechanical strength of the stopper.

The bore may continue in at least one channel within the second stopper end, which at least one channel running out in an outer surface of the stopper body at its second end, i.e. the nose portion. The channel is of characteristically reduced cross section, even compared with the cross section of the bore running through the first end of the stopper and serves for gas transport through the bore into the metal melt. While the bore within the first end may have a diameter of 30-40 mm, the enlarged bore portion may have an diameter of 50-100 mm and the channel a diameter of about 2-5 mm.

Figure 2:
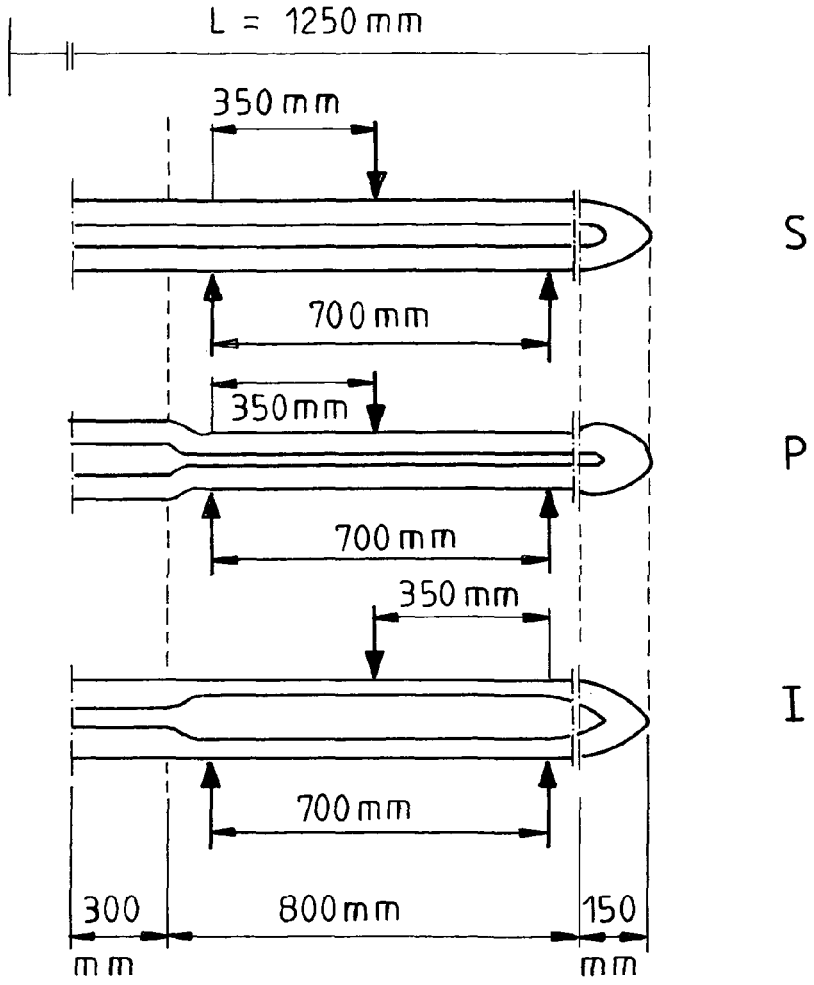
FIG. 2 shows the general design of several stoppers.

Tests have been made to compare the mechanical strength of a standard stopper S, a stopper P according to EP 1401599B1 and various stoppers I according to this invention, the general design of which is schematically shown in FIG. 2.

All stoppers had the following dimensions:

total length: 1250 mm length of first end, including the fixing region: 300 mm length of intermediate zone: 800 mm length of second end (nose portion): 150 mm which are typical dimensions of a stopper.

All stoppers were produced by the same equipment, including an isostatic press under same conditions, using identical refractory material, namely an alumina graphite material The following data further specify the tested stopper:

| Sample | D (mm) | d (mm) | wall thickness (mm) in intermediate section | total refractory volume (litres) | difference (%) to total refractory volume of stopper S | transverse strength* (Newton) |
|---|---|---|---|---|---|---|
| S | 127 | 34 | 46.5 | 13.3 | — | 2001 |
| P | 106 | 34 | 36 | 10.2 | 23.1 | 1157 |
| I1 | 127 | 88 | 19.5 | 9.2 | 31.1 | 1574 |
| I2 | 135 | 88 | 23.5 | 10.5 | 21.2 | 1979 |
| I3 | 140 | 88 | 26 | 11.3 | 14.7 | 2273 |
| I4 | 140 | 100 | 20 | 9.9 | 25.4 | 1993 |

*The transverse strength test was established according to FIG. 2. It is a 3 point bending test with 2 lower support members at a distance of 700 mm to each other and an upper load just in the middle between the two support members, i.e. at a distance of 350 mm to each of them. The said support members and upper load are arranged only along that section of the intermediate zone being of constant inner and outer diameter. Further details of the test method and testing apparatus are not decisive as only the comparative data will be regarded.

Results:

Although stoppers I2 an I4 according to the invention need about 20-25% less refractory material than the conventional stopper S their strength is just 1% less than the "full material stopper" S. Compared with stopper P the total refractory volume is more or less the same but the transverse strength is nearly twice.

Comparing stoppers I1 and S the new stopper design saves about ⅓ of refractory material.

Although stopper I1 needs less refractory material than stopper P its transverse strength is about 30% higher.

The invention will now be described by way of an example with reference to the accompanying FIG. 1, which schematically shows a longitudinal sectional view of stopper I.

The stopper has a first, upper end 10, followed downwardly by an intermediate zone 12 and a second lower end 14, the so called nose portion. First end 10, intermediate zone 12 and the adjacent part 14*o* of second end 14 have an outer diameter D, while the lower part of second end 14 is designed in a tapered fashion as known.

A bore 16 runs downwardly from an upper flat surface 10*s* of first end 10 and extends through intermediate zone 12 and slightly into part 14*o* of second end 14, followed by a small channel 18 running through second end 14 downwardly to is lowermost surface area 14*d*.

The bore 16 starts at surface 10*s* with an inner diameter d1 and runs through first end 10 with a more or less constant diameter d1 until it reaches the intermediate zone 12, where bore 16 widens smoothly into a bore section 16*s* with a diameter d2, being 2,1 the diameter d1. At the lowermost end of intermediate section 12 bore section 16*s* is designed like a funnel and merges into channel 18.

At a distance to the upper surface 10*s* a nut 20 is arranged along the wall of bore 16, said nut acting as attachment means for a lifting apparatus (symbolized by arrow A) to move the stopper up and down in a vertical direction (arrow A) as to adjust its position with respect to a corresponding nozzle 30, schematically shown in the lower part of the figure.

The stopper is made of a refractory ceramic material based on alumina and graphite and manufactured in an isostatic press.

The channel 18 is an optional feature. Thus bore portion 16*s* may end at a distance to the lower end 18 or within lower end 18. If the stopper is equipped with said channel 18 it is mostly used not only to control the outflow of a metal melt along a corresponding nozzle but as well to introduce a treating gas into the metal melt.

Said gas is then fed into the bore of the stopper at its first end and leaves the stopper at the outlet opening of channel 18, marked as 18*o* in the figure.

In such case it may be required to achieve a constant gas flow along the whole stopper bore/channel length. For this purpose and/or any other useful purposes the invention includes the possibility to fill a material of different thermo-mechanical properties (such as gas permeability, pore-size distribution, strength) compared with the refractory material of the stopper body as described above, into at least part of the ring channel defined by the bore cross section according to the first end and the enlarged bore section respectively. This ring channel is marked with dots in the figure.

The filling material may be introduced at the same time when the material for the rest of the stopper is introduced into the press, preferably an isostatic press. During filling a template may be used to separate the two materials, which is retracted before closing the mould and starting the pressing action.

The invention claimed is:

1. A stopper body made of refractory material for a valve mechanism consisting essentially of:

an elongated body having substantially cylindrical shape, which comprises a first end portion, a second end portion, and an intermediate portion between the first and the second end portions;

wherein the elongated body comprises a bore of substantially circular cross section, extending from the first end portion in an axial direction of the elongated body through the intermediate portion towards the second end portion; and wherein, a portion of the bore along at least part of the intermediate portion comprises larger cross section compared with portions of the bore along the first and the second end portions.

2. The stopper body according to claim 1, wherein the portion of the bore along at least part of the intermediate portion has at least 2 times the cross section of the portion of the bore along the first end portion.

3. The stopper body according to claim 1, wherein the portion of the bore along at least part of the intermediate portion has at least 4 times the cross section of the portion of the bore along the first end portion.

4. The stopper body according to claim 1, wherein the portion of the bore along at least part of the intermediate portion extends over 10-90% of the total length of the stopper body.

5. The stopper body according to claim 1, wherein the portion of the bore along at least part of the intermediate portion extends over 30-80% of the total length of the stopper body.

6. The stopper body according to claim 1, wherein the portion of the bore along at least part of the intermediate portion ends in front of the second end portion of the stopper body.

7. The stopper body according to claim 1, wherein a transition region of the bore between the first end portion and the intermediate portion tapers smoothly.

8. The stopper body according to claim 1, wherein a transition region of the bore between the second end portion and the intermediate portion tapers smoothly.

9. The stopper body according to claim 1, wherein the portion of the bore along at least part of the intermediate portion extends at least within the portion of the bore along the second end portions.

10. The stopper body according to claim 1, further comprising a fixing means being arranged along the portion of the bore along the first end portion for detachably securing the stopper body to a lifting mechanism.

11. The stopper body according to claim 1, wherein at least part of the portion of the bore along at least part of the intermediate portion is filled with a material of different thermo-mechanical properties compared with the refractory material of the stopper body, leaving free axially running bore along the first end portion, which is the portion of the bore along the first end portion.

* * * * *